United States Patent [19]

Matsuoka et al.

[11] Patent Number: 4,752,241

[45] Date of Patent: Jun. 21, 1988

[54] L-SHAPED BULB SOCKET

[75] Inventors: Ken Matsuoka; Kihachirou Uchida, both of Shizuoka, Japan

[73] Assignee: Koito Manufacturing Co., Ltd., Tokyo, Japan

[21] Appl. No.: 16,617

[22] Filed: Feb. 19, 1987

[30] Foreign Application Priority Data

Feb. 24, 1986 [JP] Japan ..... 61-26085[U]

[51] Int. Cl.[4] ..... H01R 19/00

[52] U.S. Cl. ..... 439/619; 439/747; 439/749; 439/558

[58] Field of Search ..... 439/619, 602, 558, 375, 439/356, 655, 890, 918, 168, 182, 220, 280, 336, 360, 414, 419, 541, 605, 614, 615, 468, 466, 702–707, 380, 733, 734, 735, 746, 747, 749, 473, 694, 741, 743, 744, 745, 748

[56] References Cited

U.S. PATENT DOCUMENTS

| | | | |
|---|---|---|---|
| 3,681,741 | 8/1972 | Litche | 439/655 |
| 3,783,435 | 1/1974 | Fisher | 439/558 |
| 3,783,437 | 1/1974 | Graff et al. | 439/619 |
| 4,473,770 | 9/1984 | Baba et al. | 439/602 |
| 4,593,958 | 6/1986 | Baba | 439/558 |

*Primary Examiner*—David Pirlot

*Attorney, Agent, or Firm*—Sughrue, Mion, Zinn, Macpeak & Seas

[57] ABSTRACT

An L-shaped bulb socket comprising an L-shaped socket consisting of a bulb receiving portion and a connector receiving portion and a pair of L-shaped terminal members which are inserted into the socket body through the terminal inserting holes formed in the bulb receiving section and the connector receiving portion of the socket body.

7 Claims, 1 Drawing Sheet

L-SHAPED BULB SOCKET

BACKGROUND OF THE INVENTION

1. Field of the Invention

This invention relates to bulb sockets for automotive lamps or the like.

2. Background of the Invention

In an automobile, the space for installation of lamps is limited and therefore it is essential to minimize the amount of backward protrusion of a lamp fixture such as a bulb socket.

This requirement may be satisfied by providing a substantially L-shaped bulb socket, such as disclosed by Eckhardt et al in U.S. Pat No. 4,609,977. However, the L-shaped bulb socket is disadvantageous in the following points. The L-shaped bulb socket requires more necessary components than the ordinary straight bulb socket. It is rather difficult to fit the terminal members in the socket body. That is, the assembly of the L-shaped bulb socket is rather difficult, with the result that the L-shaped bulb socket is high in manufacturing cost. The design of in-line bulb sockets, such as disclosed in U.S. Pat. No. 3,681,741 to Lichte is well known but is not directly applicable to L-shaped bulb sockets. A bulb socket for a wedge-base (non-metal base) bulb, offering many of the advantages of the present invention is disclosed in U.S. Pat. No. 4,101,187 to Collier. Also of interest is Japanese Utility Model Publication 53-18702 showing a three-sided, clamping electrode for a lamp.

SUMMARY OF THE INVENTION

Accordingly, an object of this invention is to eliminate the above-described difficulties accompanying the conventional L-shaped bulb socket.

More specifically, an object of the invention is to provide an L-shaped bulb socket which is made up of a small number of components, similar in number to those in the conventional straight bulb socket.

Another object of the invention is to provide an L-shaped bulb socket in which the terminal members can be readily fitted in the socket body, with the result that the manufacturing cost is decreased.

The foregoing objects and other objects of the invention have been achieved by the provision of a bulb socket which, according to the invention, comprises a substantially L-shaped socket body including a bulb insertion section and a connector connection section which are substantially perpendicular to each other.

The socket body has terminal insertion holes which are formed in the bulb insertion section and the connector connection section. A pair of substantially L-shaped terminal members are inserted in the socket body through the terminal insertion holes.

The nature, principle and utility of the invention will become more apparent from the following detailed description when read in conjunction with the accompanying drawings.

DETAILED DESCRIPTION OF THE INVENTION

One example of a bulb socket according to this invention will be described with reference to the accompanying drawings.

Figure 1:
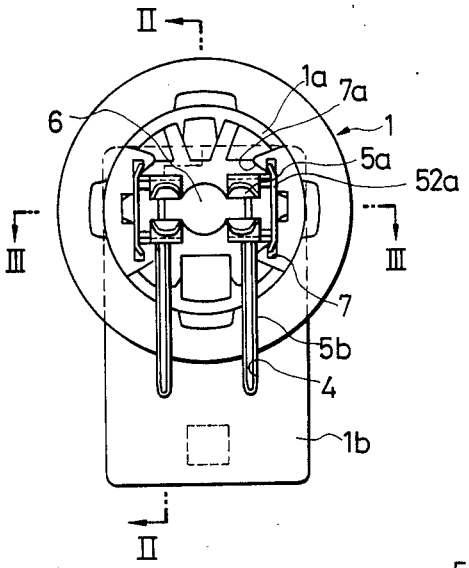
FIG. 1 is a front view showing one example of a bulb socket according to this invention.
Figure 4:
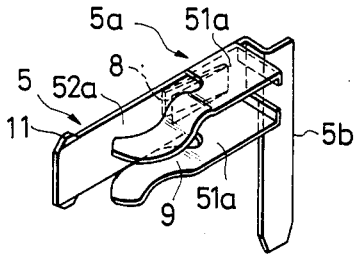
FIG. 4 is a perspective view showing a terminal member in the bulb socket according to the invention.
Figure 2:
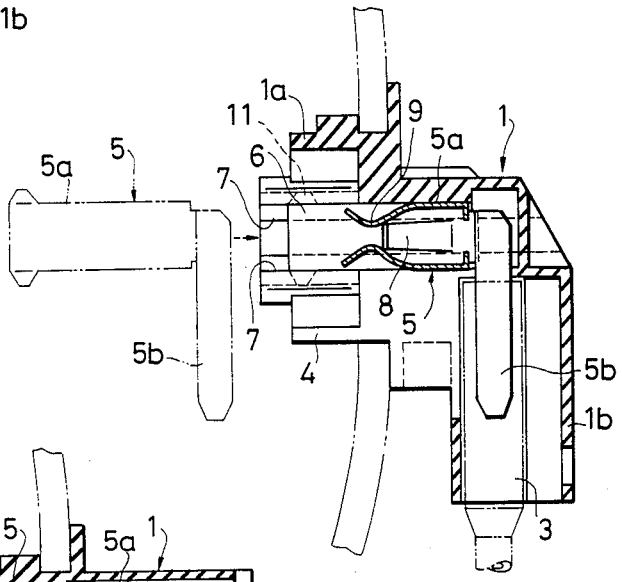
FIG. 2 is a sectional view taken along line II—II in FIG. 1.
Figure 3:
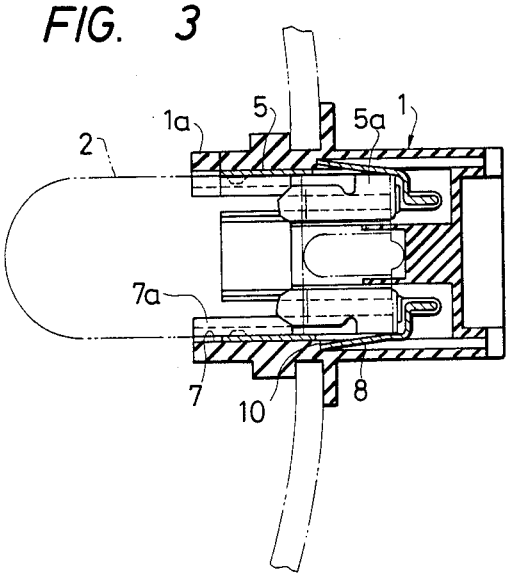
FIG. 3 is also a sectional view taken along line III—III in FIG. 1.

As shown in FIGS. 1 through 4, a socket body 1 is made up of a bulb insertion section 1*a* into which a light bulb 2 is inserted and of a connector connection section 1*b* for connecting a connector. More specifically, the bulb insertion section 1*a* and the connector section 1*b* are molded into one L-shaped unit with a resin in such a manner that the bulb insertion section 1*a* is substantially perpendicular to the connector connection section 1*b*. Mounting grooves 7 are formed in the bulb insertion section 1*a* in such a manner that the grooves 7 extend along the axis of the bulb insertion section 1*a* and confront with each other. The mounting grooves 7 are adapted to receive mounting plates 52*a* of two terminal members 5 shown in perspective in FIG. 4. The mounting grooves 7 are substantially C-shaped in section. Each of the mounting grooves 7 has two end portions 7*a* protruding to hold the cylindrical glass envelope of the light bulb 2. Terminal insertion holes or slots 4 are formed in the bulb insertion section 1*a* and connector connection section 1*b*. The two terminal members 5 are inserted into the terminal insertion holes 4. Thus, the bulb socket is constructed.

The terminal insertion holes or slots 4 extend from a bulb insertion hole 6 into the bulb insertion section 1*a* and the connector connection section 1*b* in such a manner that the terminal insertion holes 4 are slightly larger than the wall thickness of connector-side terminals 5*b* of the terminal members 5.

Each of the terminal members 5 consists of a bulb-side terminal 5*a* which is electrically connected to a terminal of the bulb 2, and the aforementioned connector-side terminal 5*b* which is electrically connected to a connector 3 supplying electrical power. More specifically, the terminal member 5 is an L-shaped metal plate having bulb-side terminal 5*a* and a connector-side terminal 5*b* which are substantially perpendicular to each other.

The bulb-side terminal 5*a* includes two contact plates 51*a* which are electrically connected to the respective terminals of the bulb 2, and the aforementioned mounting plate 52*a* which is engaged with the mounting groove 7 of the socket body 1. The contact plates 51*a* are bent substantially perpendicular to the mounting plates 52*a* so that they confront with each other. The contact plates 51*a* thus bent are curved inwardly at the end portions, thus having squeezing parts 9. On the other hand, a stopper 8 flexibly protrudes from the mounting plate 52*a* so that, when the mounting plate 52*a* is fitted in the mounting groove 7, the stopper 8 is engaged with an engaging step 10 formed in the mounting groove 7. Also, two engaging pieces 11 protrude from the end of the mounting plate 52*a* so that, when the mounting plate 52*a* is fitted in the mounting groove 7, the two engaging pieces 11 are strongly engaged with the mounting groove 7.

On the other hand, in each of the terminal members 5, the connector-side terminal 5*b* is substantially perpendicular to but in a plane parallel with the bulb-side terminal 5*a*. That is, the terminal member 5 is substantially L-shaped as was described before.

The terminal members 5 can be fitted into the socket body 1 as follows. The connector-side terminals 5*b* of the terminal members 5 are faced toward the bulb insertion hole 6 of the socket body 1 and inserted into the terminal insertion holes 4 while the bulb-side terminals 5*a* are fitted in the mounting grooves 7 formed in the bulb insertion section 1*a*. In this condition, the terminal members 5 are pushed directly into the socket body 1. As a result, the connector-side terminals 5*b* of the terminal members 5 are held in the connector section 1*b* of the socket body 1 after passing through the terminal insertion holes or slots 4. At the same time, the bulb-side terminals 5*a* are held in the bulb insertion section 1*a* of the socket body 1 with the stoppers 8 of the bulb-side terminals 5*a* engaged with the mounting holes 7 in the bulb insertion section. The terminal members are thus completely inserted into the socket body 1, completing the construction of the bulb socket.

As is apparent from the above description, the bulb socket is designed so that its socket body is substantially L-shaped. However, as in the ordinary linear bulb socket, the components of the bulb socket of the invention include the socket body comprising the bulb insertion section and the connector connection section which are formed as one unit. The bulb socket also includes two terminal members each of which is made up of a bulb-side terminal and a connector-side terminal which are also formed as one unit. Furthermore, the terminals members can readily be fixed in the socket body merely by pushing them through the terminal insertion holes formed in the socket body. Thus, the bulb socket of the invention can be readily assembled and can be made at a low manufacturing cost.

What is claimed is:

1. A bulb socket, comprising;

a substantially L-shaped one piece socket body, said body including a bulb insertion section having an opening extending in a first direction and an electrical connector connection section having an opening extending in a second, substantially perpendicular direction;

said body defining terminal insertion slots having a length direction substantially parallel to said second direction, and extending in a depth direction substantially completely through that part of said socket body defining said bulb insertion opening; and substantially L-shaped terminal members inserted into said socket body from the bulb insertion opening side of said socket body via said terminal insertion slots, and including bulb contacting means and substantially perpendicular connector contacting means, said connector contacting means extending in said second direction and having a length which is less than that of said slots.

2. A bulb socket as recited in claim 1, wherein said slots have a width in a third direction perpendicular to said first and second directions slightly larger than a thickness of said terminal member.

3. A bulb socket as recited in claim 2, wherein sides of said bulb insertion section opposed in said third direction have steps formed therein and wherein each of said terminals has an engaging member for engaging one of said steps.

4. A bulb socket as recited in claim 3, wherein said bulb insertion section includes two pairs of grooves extending in said first direction for respectively holding on of said terminals.

5. A bulb socket as recited in claim 4, wherein each of said terminals includes engaging pieces extending in said second direction for engaging said grooves.

6. A bulb socket as recited in claim 5, wherein each of said terminals includes a pair of squeezing members for grasping a light bulb terminal.

7. A bulb socket as recited in claim 4, wherein portions of said socket body defining on a first side thereof said grooves have second sides extending parallel to said grooves for contacting a bulb inserted into said bulb insertion section.

* * * * *